US010358989B2

(12) United States Patent
Uriona et al.

(10) Patent No.: US 10,358,989 B2
(45) Date of Patent: Jul. 23, 2019

(54) METHOD FOR CONTROLLING A HYDRAULIC PUMPING SYSTEM, AND CORRESPONDING CONTROL DEVICE AND PUMPING SYSTEM

(71) Applicant: EKU Power Drives GmbH, Stuttgart (DE)

(72) Inventors: Leonardo Uriona, Stuttgart (DE); Manuel Klein, Stuttgart (DE); Edward Eichstetter, Stuttgart (DE)

(73) Assignee: EKU POWER DRIVES GmbH, Stuttgart (DE)

( * ) Notice: Subject to any disclaimer, the term of this patent is extended or adjusted under 35 U.S.C. 154(b) by 0 days.

(21) Appl. No.: 16/056,751

(22) Filed: Aug. 7, 2018

(65) Prior Publication Data

US 2018/0340477 A1 Nov. 29, 2018

Related U.S. Application Data

(63) Continuation of application No. PCT/EP2017/052345, filed on Feb. 3, 2017.

(30) Foreign Application Priority Data

Feb. 9, 2016 (DE) ..... 10 2016 102 220

(51) Int. Cl.
*F02D 29/04* (2006.01)
*F04B 35/04* (2006.01)
(Continued)

(52) U.S. Cl.
CPC ..... *F02D 29/04* (2013.01); *E21B 43/26* (2013.01); *F04B 35/045* (2013.01); *F04B 49/06* (2013.01);
(Continued)

(58) Field of Classification Search
CPC ..... F16H 41/24; F16H 41/28; F16H 41/30; F02D 29/04; F04B 35/045; F04B 49/065; F04B 2203/0209; E21B 43/26
See application file for complete search history.

(56) References Cited

U.S. PATENT DOCUMENTS 5,540,554 A * 7/1996 Masuzawa ..... F04B 49/065 417/20
6,010,309 A * 1/2000 Takamura ..... E02F 9/2235 417/218
(Continued)

FOREIGN PATENT DOCUMENTS

DE 10119852 A1 10/2002
DE 102010003421 A1 10/2011
(Continued)

OTHER PUBLICATIONS

International Search Report for International Application No. PCT/EP2017/052345, dated May 17, 2017.
(Continued)

*Primary Examiner* — Patrick Hamo
(74) *Attorney, Agent, or Firm* — Jason H. Vick; Sheridan Ross, PC

(57) ABSTRACT

Method for controlling a hydraulic pumping system that is stationary while in operation, the pumping system comprising a fuel-driven drive with a motor for a pump, a heating device for heating the motor and an accumulator with a charge control, the method comprising the steps of: detecting at least a first operating value, determining a current and an expected operating mode, and influencing at least a second operating value. Further, a control device for a hydraulic pumping system that is stationary while in operation, and a hydraulic pumping system that is stationary while in operation are also provided.

42 Claims, 5 Drawing Sheets

(51) Int. Cl.
*F04B 49/06* (2006.01)
*E21B 43/26* (2006.01)

(52) U.S. Cl.
CPC ..... *F04B 49/065* (2013.01); *F02N 2200/023* (2013.01); *F04B 2203/0209* (2013.01)

(56) References Cited

U.S. PATENT DOCUMENTS

| | | | | |
|---|---|---|---|---|
| 8,589,002 | B1 | 11/2013 | Henry et al. | |
| 2014/0158350 | A1* | 6/2014 | Castillo | E21B 23/10 166/250.17 |
| 2014/0234059 | A1 | 8/2014 | Thomeer | |
| 2015/0211512 | A1 | 7/2015 | Wiegman et al. | |
| 2015/0369351 | A1 | 12/2015 | Hermann et al. | |
| 2016/0032703 | A1 | 2/2016 | Broussard et al. | |
| 2018/0187662 | A1* | 7/2018 | Hill | F04B 47/02 |

FOREIGN PATENT DOCUMENTS

| | | | |
|---|---|---|---|
| DE | 102014211964 | A1 | 12/2015 |
| DE | 102014012043 | A1 | 2/2016 |

OTHER PUBLICATIONS

Written Opinion for International Application No. PCT/EP2017/052345, dated May 17, 2017.
Search Report for corresponding German Application No. 102016102220.9 dated Jan. 17, 2017.
International Preliminary Report on Patentability for International Application No. PCT/EP2017/052345, dated Aug. 23, 2018.

* cited by examiner

METHOD FOR CONTROLLING A HYDRAULIC PUMPING SYSTEM, AND CORRESPONDING CONTROL DEVICE AND PUMPING SYSTEM

CROSS REFERENCES TO RELATED APPLICATIONS

This application is a Continuation of International Application No. PCT/EP2017/052345 filed on Feb. 3, 2017, designating the U.S., which International Patent Application claims priority under 35 U.S.C. § 119 to German patent application DE 10 2016 102 220.9 filed on Feb. 9, 2016. The entire contents of these priority application are incorporated herein by reference.

BACKGROUND

This disclosure relates to a method of controlling a hydraulic pumping system that is stationary while in operation with a fuel-driven drive with a motor for a pump, a heating device and an accumulator with a charge control system.

The disclosure relates in particular to a pumping system which is designed as a hydraulic pumping system, in particular with a plunger pump, for use in fracking, whereby the pumping system has no electrical network access, in particular no network access by an energy provider feeding its network with several power plants. Since the effects are regarded as advantageous for use in some exemplary embodiments for fracking, especially with a hydraulic pumping system, the disclosure is described below on the basis of this possible application.

A hydraulic pumping system for use in fracking includes, among other elements, a hydraulic pump, a motor and a transmission arranged on a trailer. There is also a tractor that can be coupled to the trailer. The engine of the tractor is coupled to the engine of the pump via a hydraulic system, via which the engine of the pump can be started. The starting process is effected by means of a hydraulic starter. A pre-lubrication pump builds up the oil pressure in the system during the starting process in order to reduce wear. The tractor engine can support the pumping system's electrical system, usually 24 V, when the pump engine is not running. The tractor is also used to transport the pumping system to different locations. An example of such a conventional system will be briefly explained later.

Several pumping systems are arranged at a drilling site, which are connected to each other via a manifold outside the trailers. During production, for example, a water-sand mixture is pumped into the ground at high pressure to break up rock strata, and the pumping systems typically remain at one drilling site for between 10 and 21 days, after which the pumping systems on the trailer are moved to the next drilling site by the tractor.

Hydraulic fracking takes place in several phases, also called stages, for example 20 to 30 phases. During one phase, for example, the water-sand mixture is pressed under high pressure into the ground. Between these phases, or stages, there is a resting phase, usually lasting one or more hours. During the resting phase the pumps do not deliver high pressure. According to the state of the art the pump motor remains in operation so that the pumping system is immediately ready for use again when the next phase is to be started.

In the context of the disclosure it was found that it is energetically inefficient to run the pump's motor during the rest periods. Although switching off the motor seems an obvious solution here, it was recognized in the context of the disclosure that this can lead to a significant cooling of the pump's motor, especially in cold ambient conditions. The resulting cold start of the motor leads to considerable wear and can lead to a loss of the manufacturer's warranty in the event of frequent cold starts.

Specifically, after 2 hours of production, there is typically a rest period of up to 4 hours. This means that pumping takes place for only about 35 hours on average per 100 hours of engine operation, while the engine runs inefficiently during the remaining time, i.e. during the rest periods. In addition, other power demanding electrical consumers have to be supplied on the trailer during the rest periods.

In the context of the disclosure it was also considered using a powerful electrical heater for the pump motor. However, it was recognized that such an electrical heater requires a very powerful—and therefore very expensive—accumulator due to the lack of mains access. Further, such an accumulator must be replaced regularly due to its limited service life, which leads to high operating costs.

In addition, the cost of the accumulator should be in proportion to the cost savings in motor maintenance costs. A larger or more powerful accumulator is generally not an economical solution. The disclosure makes it possible to keep the storage capacity of the accumulator as small as possible while at the same time achieving cost savings in the operating costs of the motor.

SUMMARY

Despite these considerations, therefore an object remains to disclose an improved method of controlling a hydraulic pumping system that is stationary while in operation and a corresponding control device.

According to a first aspect, the object is achieved by a method for controlling a hydraulic pumping system that is stationary while in operation with a fuel-driven drive with a motor for a pump, a heating device for heating the motor and an accumulator with a charge control, the method comprising the steps:

- acquiring at least one first operating value of the pumping system,
- determining a current operating mode of the pumping system taking into account the at least one first operating value,
- determining an expected operating mode which follows the current operating mode in time, taking into account the current operating mode,
- determining at least one ideal setpoint of the pumping system taking into account the expected operating mode for at least one target operating mode, and
- influencing at least one second operating value of the pumping system during the at least one target operating mode, taking into account the at least one ideal setpoint.

A special feature of the present disclosure is that, among other things, a current operating mode of the pumping system is determined and, taking into account the current operating mode, an expected operating mode which follows the current operating mode in time is determined. Taking into account the expected operating mode, whereby the current operating mode and/or further data can also be taken into account, at least one ideal setpoint of the pumping system is then determined for at least one target operating mode.

Knowing the at least one ideal setpoint the operation of the pumping system during the at least one target operating mode is influenced. The at least one target operating mode may be the current operating mode and/or one or more operating modes which follow the current operating mode in time. In the case of a temporally subsequent operating mode, the target operating mode is in particular the operating mode immediately following in time or the at least one target operating mode comprises the immediately following operating mode in time.

By determining the at least one ideal setpoint of the pumping system for at least one target operating mode, taking into account the expected operating mode, like taking into account a look-ahead, an improved control of the pumping system becomes possible. Specific embodiment of these improved possibilities are explained in more detail using exemplary embodiments.

It should be noted that the steps of determining may include, on the one hand, the retrieval of available data which can be used to reliably determine the current operating mode. Such data may be obtained in particular from internally stored data or tables or even via a network of other pumping systems. The step of determining shall also comprise a plausible assumption, if no data can be retrieved or are available which enable a reliable determination. In particular, the disclosure comprises cases in which the current operating mode and/or the expected operating mode cannot be determined reliably but with a sufficient reliability.

Although it is considered advantageous for some exemplary embodiments if both the current operating mode and the expected operating mode are always correctly determined, the advantages of the disclosure can also be achieved for some exemplary embodiments if the operating modes can only be determined with a certain reliability.

For some exemplary embodiments at least one operating mode is a standby mode in which the pump motor is switched off and comes to a standstill, between two successive production phases in which the pumps operate under high pressure and press material into the borehole, particularly between two test phases or between a test phase and a production phase.

This method may make it possible to operate the pumping system without an additional engine and a hydraulic system, which are usually located on the tractor, i.e. neither a hydraulic connection nor an electrical connection to the tractor is required to operate the pumping system, which means that the tractor can be used elsewhere after the trailer has been parked, which may be particularly cost advantageous for some exemplary embodiments.

Advantages of the disclosure for some exemplary embodiments may lie in a higher utilization of the system, a reduced maintenance effort, as well as an increase in cost efficiency, time efficiency and energy efficiency.

In an exemplary embodiment, the method also has the step of determining an expected remaining duration of the current operating mode, whereby the influence of the at least one second operating value also takes into account the expected remaining duration.

This exemplary embodiment may make it possible to influence the at least one second operating value, for example, depending on whether the current operating mode will probably remain active for a longer period or whether the current operating mode is already approaching its end.

In another exemplary embodiment, the at least one first operating value has at least two first operating values that were recorded at two different times.

This exemplary embodiment may allow for an increased accuracy in determining the current operating mode. Since determining the expected operating mode takes into account the current operating mode, an improved determination of the expected operating mode can be made possible.

In another exemplary embodiment, the at least one first operating value has at least two first operating values, one of the at least two first operating values being acquired during the current operating mode and another of the at least two first operating values being acquired before the current operating mode.

This exemplary embodiment may also enable an improved determination of the current operating mode and thus, where appropriate, also of the expected operating mode.

In another exemplary embodiment, the at least one second operating value has a heating level of the heating device.

This exemplary embodiment may influence the heating device for the motor in knowledge of the expected operating mode. This allows to influence the temperature of the motor.

In another exemplary embodiment, the influencing the at least one second operating value comprises an increase in the heating level during the at least one target operating mode compared to a standard heating level in the at least one target operating mode.

This exemplary embodiment may make it possible to heat up the engine during the target operating mode more than is usually the case without influencing it according to this disclosure. For example, a standard heating level is "off" during a production mode, i.e. the engine is not additionally heated, but its temperature corresponds to the combustion heat. This increase in the heating level compared to the standard heating level would mean that, for example, a low heating power or a high heating power is supplied. Or, as a further example, if during another operating mode a standard heating level is supplied with a low heating power, the increase in the heating level means the setting of a high heating level.

Under a low heating level, the preferred electrical heating capacity should be between 1 kW to 8 kW, particularly preferably between 2 kW and 7 kW, more preferably between 3 kW and 6 kW, and in particular between 4 kW and 5 kW. a high heating capacity is above the low heating capacity and is preferably at least 6 kW, particularly preferably at least 8 kW, more preferably at least 9 kW and in particular at least 10 kW.

In another exemplary embodiment, increasing the heating level means that during a production mode and/or a test mode the heating device is operated at least at low heating power, in particular at high heating power, whereby the increased heating level can be selected during at least one complete target operating mode, but also only partially during at least one target operating mode.

In another exemplary embodiment, the at least one second operating value comprises a charging power of the accumulator.

This exemplary embodiment may influence the charging power of the accumulator with knowledge of the expected operating mode. This can influence the charging process for the accumulator. In particular, depending on the current and expected operating mode, a consideration can be made between fast charging before the motor is switched off and slow charging for a longer service life of the accumulator.

In another exemplary embodiment, the at least one second operating value shows an increase in charging power during the at least one target operating mode compared to a standard charging power in the target operating mode.

This exemplary embodiment may make it possible for some exemplary embodiments to charge the accumulator advantageously. The term standard charging power in the target operating mode should be understood in particular as a charging power that is selected depending on the current state of charge of the accumulator and, in particular, does not take into account an expected operating mode following in time. The increase in charging power compared to the standard charging power therefore means that the charging power is selected above a value that would result solely with regard to the state of charge of the accumulator.

In this context, it should be noted that the basic aim of the skilled person is to keep charging power, in particular charging current, as low as possible for the accumulator. A slow charging of the accumulator usually leads to a longer service life of the accumulator compared to a fast charging with high charging power or charging current. This means that the increase in charging power compared to the standard charging power also means in particular that charging power is increased, although the skilled person would consider a lower charging power as sufficient in accordance with the state of the art in order to achieve an increased service life due to the lower charging power.

This approach may have the particular advantage for some exemplary embodiments of bringing the accumulator to the highest possible state of charge before a standby mode in which the engine is switched off, so that sufficient electrical power can be made available from the accumulator during the standby mode for the longest possible period. In particular it is intended to cover the entire rest phase without having to start the engine.

The increased charging power can be applied during at least one complete target operating mode, but also only partially during at least one target operating mode.

In another exemplary embodiment, at least one determination selected from determining the current operating mode and determining the expected operating mode is performed taking into account a typical sequence of operating modes of the pumping system.

This exemplary embodiment may allow for an improved determination of the current operating mode and thus, if necessary, the expected operating mode. Although the sequence of the different operating modes can in principle be freely selected while in operation of the pumping system, typical sequences result in practical operation: For example, a production mode is usually followed by a rest phase at idle speed. Or, as another example, a production mode is usually preceded by a test mode, which in turn is usually temporally separated from the production mode by a rest phase. Since in particular a resting phase or a production mode can be correctly identified with a high reliability, the consideration of a typical sequence of operating modes can improve the aforementioned determination.

In another exemplary embodiment, data on a sequence of pumping system operating modes is stored during pumping system operation and a typical sequence of pumping system operating modes is determined.

It is possible to preset a typical sequence of pumping system operating modes, but in this exemplary embodiment, the pumping system operation is monitored by storing data on a sequence of operating modes. From an analysis of the stored data, the sequence of operating modes that is typical for this pumping system can be determined. The data stored and from which the typical sequence is determined comprise in particular at least one element selected from the group consisting of average duration for an operating mode, stage number, motor speed, flow through the pump, and borehole pressure.

A stage number may be understood in particular as follows: The work on a borehole is divided into a certain fixed number of stages, in particular between 20 and 30. For each stage a certain operating mode is necessary, which manifests itself for example in certain values for the parameters pressure, flow rate and duration, usually depending on the geological parameters. Often several drill holes are drilled in the same area, and it is highly probable that they will be drilled in the same sequence or in the same operating mode.

In another exemplary embodiment, the step of influencing comprises an influencing such that a temperature of the engine at the end of a standby mode is above a cold-start temperature.

This exemplary embodiment may ensure that the engine temperature is above a cold start temperature when the engine is restarted. The cold start temperature as understood by the skilled person is the temperature at which considerable wear occurs when the engine is started due to the lack of heat in the engine. The cold start temperature is generally specified by the engine manufacturer, whereby the manufacturer either does not allow the engine to be started at or below the cold start temperature or only permits a certain number of such so-called cold starts over a certain period of time. In particular, a normal cold start temperature is 40° C. or below 40° C. if the engine is designed with a typical design. In an exemplary embodiment, the influencing is such that the engine temperature is above a cold-start temperature during the entire standby mode.

It should also be noted that the cold start temperature is generally set individually by each manufacturer. However, for general orientation it can be noted that a cold start usually describes an engine temperature below 20-40° C. at engine start. In addition, the manufacturer can define a quick start or emergency start temperature. Once this temperature is reached, the motor can produce its full power without any wear disadvantages. The quick start temperature is usually 60-80° C.

In another exemplary embodiment, the step of influencing has an influencing that delays the start of a standby mode and increases a charging current into the accumulator.

This exemplary embodiment may make use of the engine already running in order to continue to produce electrical energy by letting the engine continue to run in order to further charge the accumulator. For the period by which the start of a standby mode is delayed, a high charging capacity or a high charging current into the accumulator is selected. In this way, the charge level of the accumulator can be further increased within a short time so that sufficient electrical power is available from the accumulator during the subsequent standby mode in which the motor is at a standstill. The term sufficient means in particular that the entire rest phase can be covered without having to restart the motor to charge the accumulator.

The term low or high charging current should be understood as follows. Low or high should be understood in terms of the ratio of charging current and accumulator capacity C. A low charging current has a maximum of 2 C, preferably a maximum of 1.5 C, especially preferably a maximum of 1 C and especially a maximum of 0.5 C. A high charging current is at least 2 C, preferably at least 2.5 C, especially preferably at least 3 C and especially at least 3.5 C. In one embodiment, accumulator capacity with C=100 Ah is assumed. Then a low charging current of 0.5 C=>0.5*100=50 A. A high charging current with 4 C=>4*100=400 A.

In another exemplary embodiment, the current operating mode and the expected operating mode are each selected from a group comprising a production mode, at least one test mode and a standby mode.

During the production mode, material is pumped by the pump under high pressure, in particular the water-sand mixture is pressed into the ground. In the at least one test mode, the system checks whether the entire system is ready for use before the production mode. In particular, there is a first test mode, which is a short system test that is performed without pressure, and a second test mode that is performed under pressure. In the context of this disclosure, standby mode means that the motor stops, i.e. the speed of the motor is zero. In particular, the ignition is also switched off. However, the engine is kept in a condition in which it is immediately ready for use, especially with regard to engine temperature, engine oil pressure, engine electronics and auxiliary units. The aim is to control everything in such a way that the engine can be started immediately and its entire power can be demanded.

In another exemplary embodiment, the at least one first operating value, the at least one second operating value and the ideal setpoint are each selected from a group comprising a temperature of the engine, a speed of the engine, a gear of the drive, a time period from leaving a first gear step until reaching a second gear step, a time period of holding a gear step, a current operating mode, a previous operating mode, a heating level of the heating device, a charging state of the accumulator, a charging power of the accumulator and a starting process of the engine.

This exemplary embodiment allows a multitude of possibilities for control, whereby the term control in the context of this disclosure also includes a control with feedback. The following are just a few non-exhaustive embodiments. If the temperature of the engine is taken into account, it is possible, in particular, by heating up the engine, in particular by additionally heating up the engine, before the pumping system enters standby mode, to achieve a temperature of the engine which stores so much heat in the engine that less or even no heating energy needs to be supplied during standby mode in order to keep the engine above the cold-start temperature, in particular to be able to cover a longer standby phase, e.g. four hours, without having to recharge the accumulator.

The speed of the motor may be taken into account, for example, to determine the current operating mode of the pumping system. The gear level of the drive can be used, for example, to detect an idle state or standby mode when the gear level is set to neutral. The time from leaving a first gear step to reaching a second gear step can be used, for example, to distinguish different test modes. While a test mode without pressure can be detected in particular by a quick change of gear steps, a second test mode under pressure can be detected in particular by a slow shift through different gear steps. Preferably the borehole pressure is calculated by torque, gear and speed.

In the simplest case, a current operating mode can be identified in an exemplary embodiment by providing information about the current operating mode, for example by a switch, programming or a predefined setting. An earlier operating mode can be used to correctly detect the current operating mode and/or the expected operating mode with a higher reliability. A heating level of the heating device and a charging capacity of the accumulator can be increased as described above, especially before switching to standby mode. A state of charge of the accumulator, in particular the voltage level of the accumulator, can be used to control the charging power or the charging current into the accumulator. For example, an engine startup may indicate the start of production mode.

In addition, the at least one first operating value, the at least one second operating value and the ideal setpoint may alternatively or additionally be selected from a group comprising electrical power consumption of one or more auxiliary units and/or components, temperature of the auxiliary units, duration of an earlier operating mode, estimated duration of the current operating mode, estimated duration of the following operating mode, ambient temperature, wind force, motor power, motor torque, oil pressure (motor and auxiliary units), accumulator service life, maximum operating voltage of the accumulator, maximum operating voltage of the system and borehole pressure.

According to a second aspect, the object is achieved by a control device for a hydraulic pumping system that is stationary while in operation with a fuel-driven drive with a motor for a pump, a heating device for heating the motor and an accumulator with a charge control, the control device with a processing unit which is designed to carry out a method described above.

According to a third aspect, the object is achieved by a pumping system with a control device mentioned above.

It goes without saying that the features mentioned above and those to be explained below can be used not only in the combination indicated, but also in other combinations or in isolation, without leaving the scope of this disclosure.

Embodiments of the disclosure are shown in the drawings and are explained in more detail in the following description.

DESCRIPTION OF EXEMPLARY EMBODIMENTS

Figure 1:
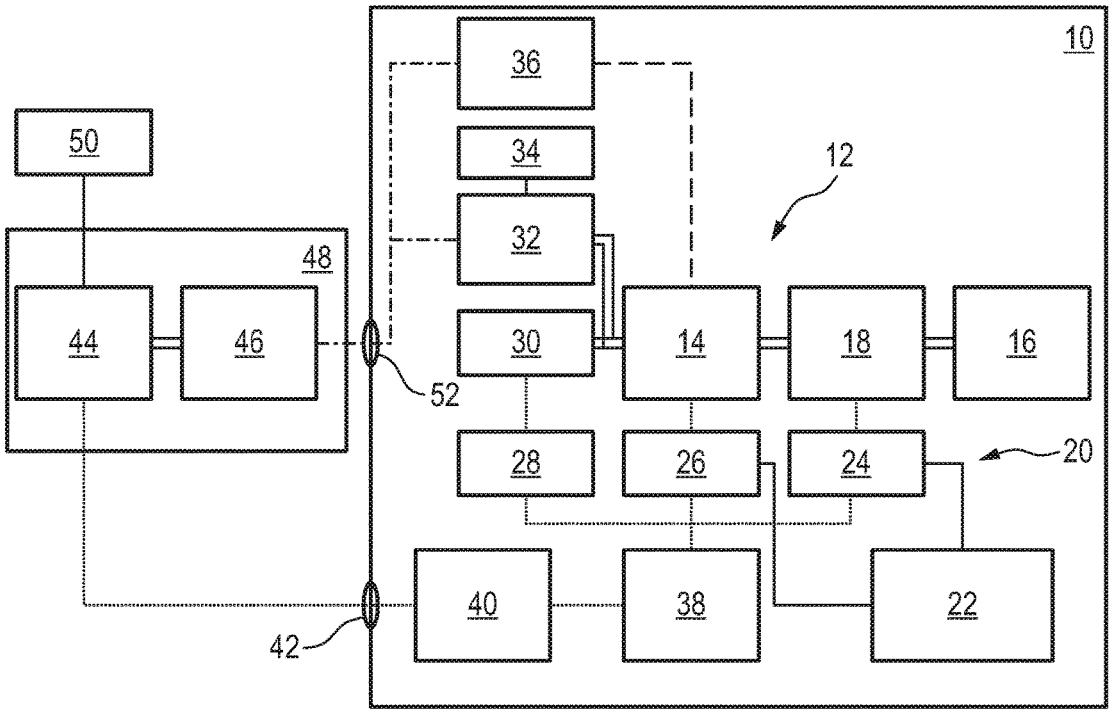
Fig. 1 (Prior Art)
FIG. 1 shows an embodiment of a conventional hydraulic pumping system for use in fracking.

FIG. 1 shows a hydraulic, conventional pumping system 10 that is stationary while in operation with a fuel-driven drive 12 with a motor 14 for a pump 16. The motor 14 and the pump 16 are coupled via a transmission 18.

The pumping system 10 has a control device 20 with a user control 22, a transmission control 24, an engine control 26 and a voltage regulator 28. The motor 14 is connected to an alternator or generator 30 and mechanically connected to a hydraulic starter 32. The hydraulic starter 32 is manually controlled by a first starter control 34.

The pumping system 10 also has a pre-lubrication pump 36, an accumulator 38 with 24 V operating voltage and a voltage converter 40, which is electrically connected to an electrical interface 42 and the accumulator 38. The pumping system 10, which is arranged here on a trailer, comprises a vehicle motor 44 and a hydraulic system 46, which are arranged on a tractor 48. Vehicle motor 44 is controlled via a second starter control 50. The hydraulic system 46 is connected to the hydraulic starter 32 via a hydraulic interface 52.

To illustrate the different connections, the cooling/lubrication connections are shown as dashed line, the hydraulic connections as dash-dotted line, the electrical connections as dotted line, the control connections as continuous line and the mechanical connections as double line. This form of representation is also used in the other figures. In addition, the same reference symbols are retained below, provided that the designated elements are the same elements or elements of the same type with similar functions.

Figure 2:
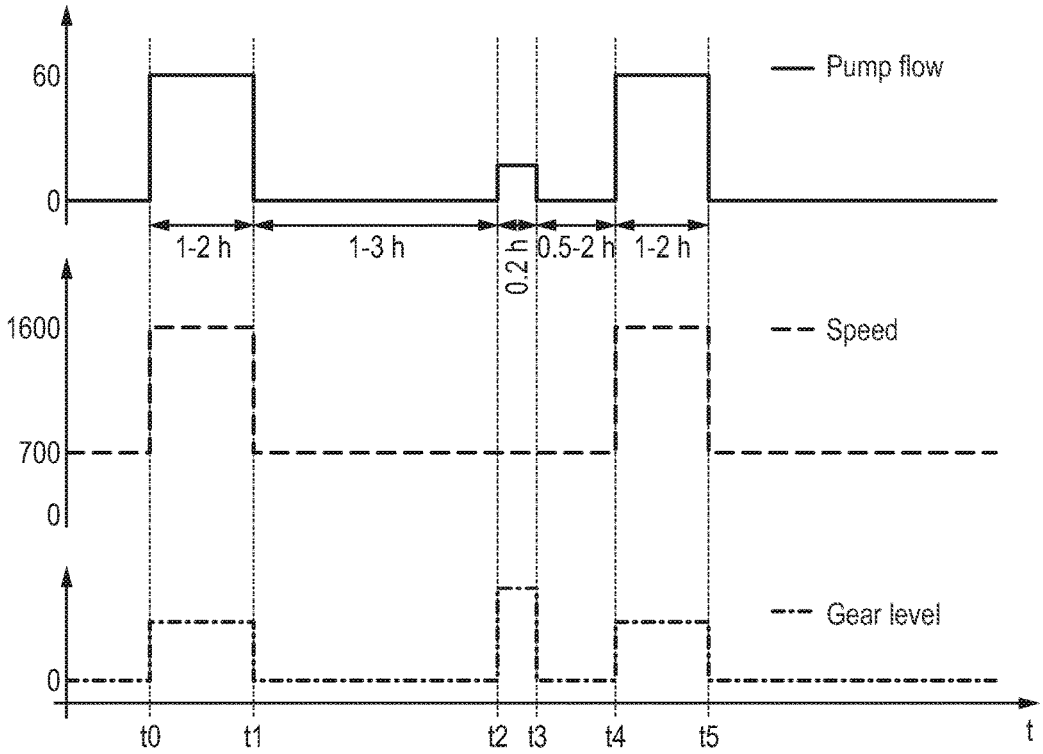
Fig. 2 (Prior Art)
FIG. 2 shows an embodiment of a conventional production process of a conventional hydraulic pumping system.

FIG. 2 shows an exemplary conventional production process: the time is plotted horizontally, i.e. along the x-axis. The pump flow, the engine speed and the gear level used are plotted vertically, i.e. along the y-axis, from top to bottom.

The process is initially in a rest mode, i.e. the engine is idling at 700 rpm. The production mode starts at a time t0. The engine speed is increased to 1600 rpm, a middle gear level is engaged, and the pump flow increases to 60% of the maximum pump flow. The production mode continues for 1 to 2 hours.

After the production mode has ended at time t1, the system returns to sleep mode, e.g. within one to four hours. From time t2 to t3 the system is in a test mode with a high gear level engaged so that the pump flow is slightly increased, even if the engine remains idling.

From time t3 on the pumping system is back in idle mode, from time t4 back in production mode, and from time t5 back in idle mode.

Figure 3:
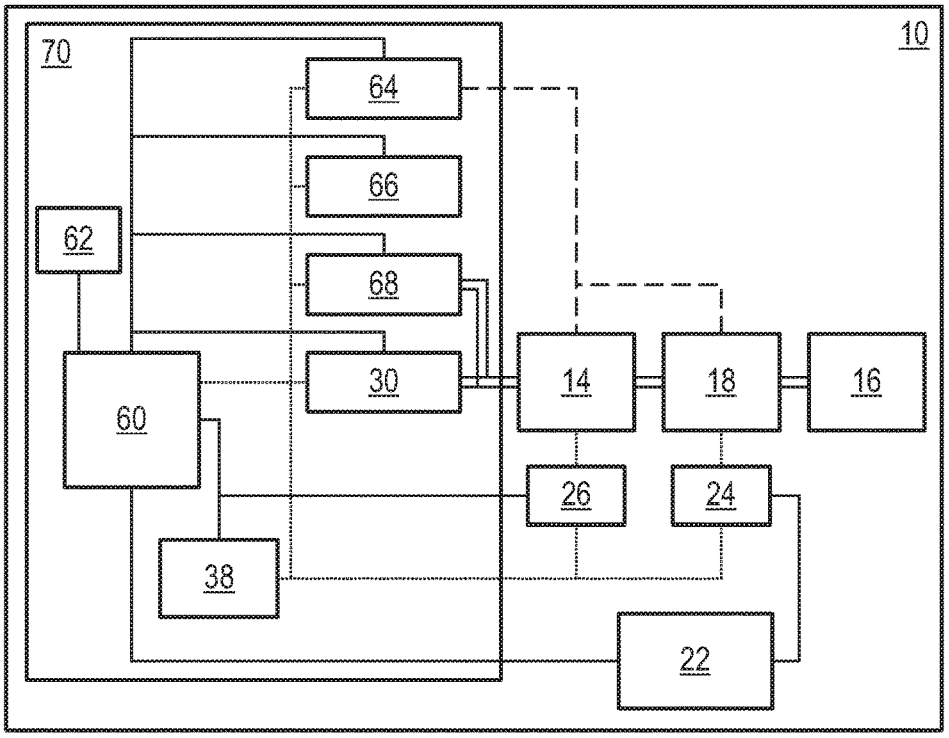
FIG. 3 shows a first embodiment of a pumping system.

FIG. 3 shows a first embodiment of a pumping system 10. A control device 60, a data network connection 62, a purely electric heating device 64, optionally further auxiliary units 66, at least one electric starter 68, at least one generator 30 and an accumulator 38 form a functional unit 70. The main functions of the functional unit 70 are to be able to switch off motor 14 during a production process and to restart it at any time immediately above a cold start temperature. Immediately means that after a start request the motor 14 runs again preferably after 10 s at the most, especially preferably after 5 s at the most and especially after 3 s at the most and can supply its maximum power if needed.

The functional unit 70, also known as the automatic standby system, can be placed on the trailer described above, eliminating the need for the tractor to be available to operate the pumping system. The hydraulic systems otherwise required, such as the hydraulic starter, are replaced with the functional unit 70.

Figure 4:
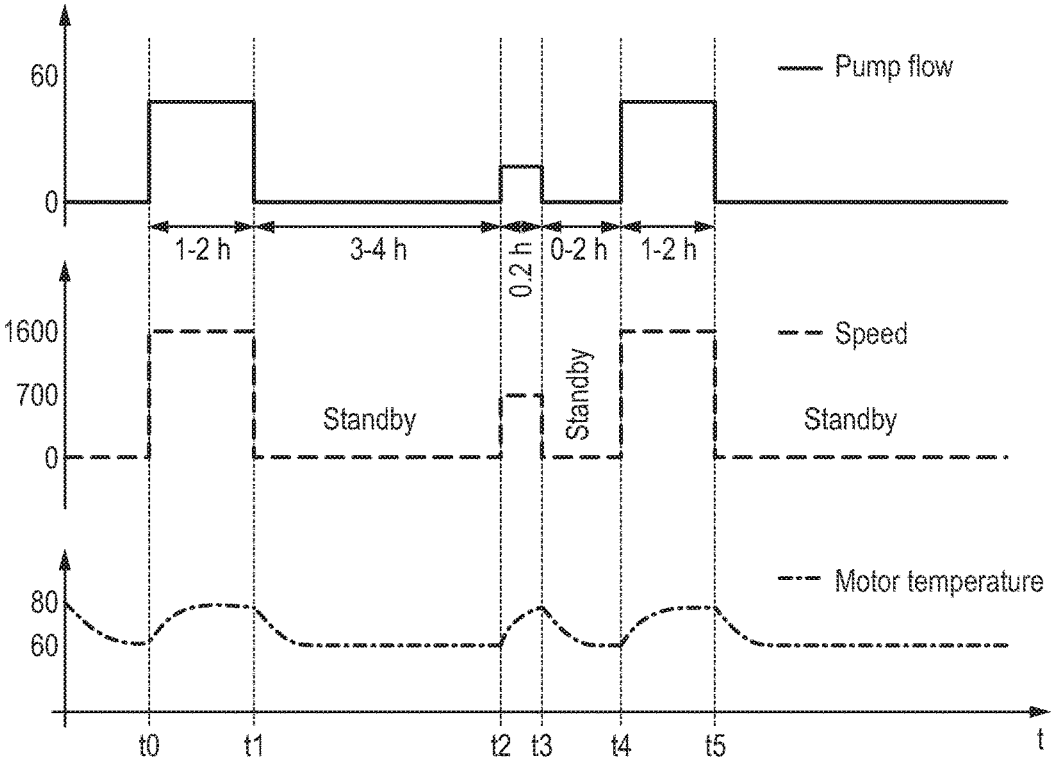
FIG. 4 shows a corresponding production process.

FIG. 4 shows an exemplary production flow with the pumping system 10 according to FIG. 3. The time is plotted horizontally, i.e. along the x-axis. The pump flow, the motor speed and the motor temperature used are plotted from top to bottom in the vertical direction, i.e. along the y-axis.

This embodiment assumes a cold start temperature of 60° C. As can be seen from the engine temperature curve, the engine temperature when starting the engine, see times t0, t2 and t4, is not lower than the cold start temperature. In particular, the engine temperature is never lower than the cold start temperature. In an embodiment, the going below the cold start temperature is prevented by actuating the electric heating device 64. The heating power during standby mode is set as a function of the motor temperature. In particular, the control can be carried out in such a way that the closer the engine temperature is to the cold-start temperature, the higher the heat output is selected. Alternatively or additionally, the heating power can be controlled depending on a capacity of the accumulator, a remaining duration and/or motor wear.

Figure 5:
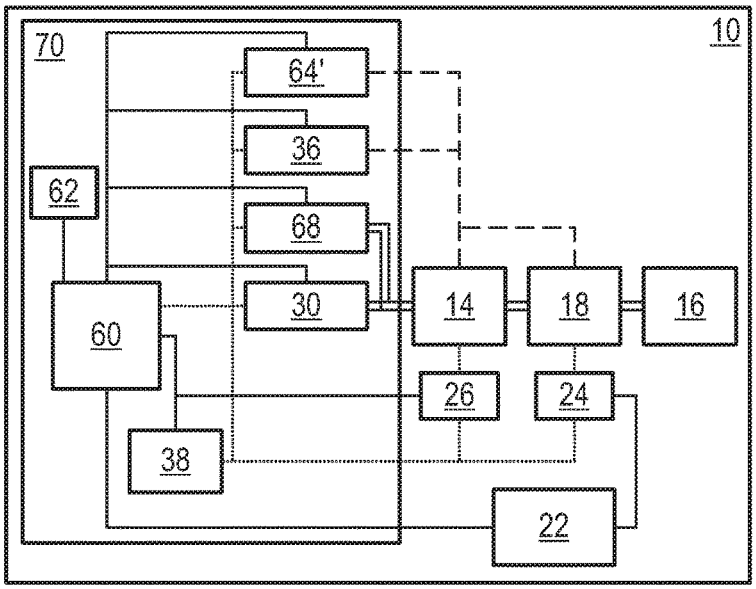
FIG. 5 shows a second embodiment of a pumping system.

FIG. 5 shows a second embodiment of a pumping system 10. The above explanations also apply to this embodiment, so that only the differences should be explained.

This embodiment uses a diesel-electric heater instead of the 64' electric heater 64. This may be advantageous for some exemplary embodiments because diesel fuel is already available to operate the motor 14 and the capacity of the accumulator 38 can be considerably reduced because the heating capacity is no longer provided by the accumulator 38. The accumulator 38 is then essentially only used to operate a coolant pump that pumps the heated coolant through the motor 14, and to operate various electronic elements whose power consumption is low.

The auxiliary unit 66 shown in FIG. 3 is not shown here, but is present, and a pre-lubrication pump 36 is also present.

Figure 6:
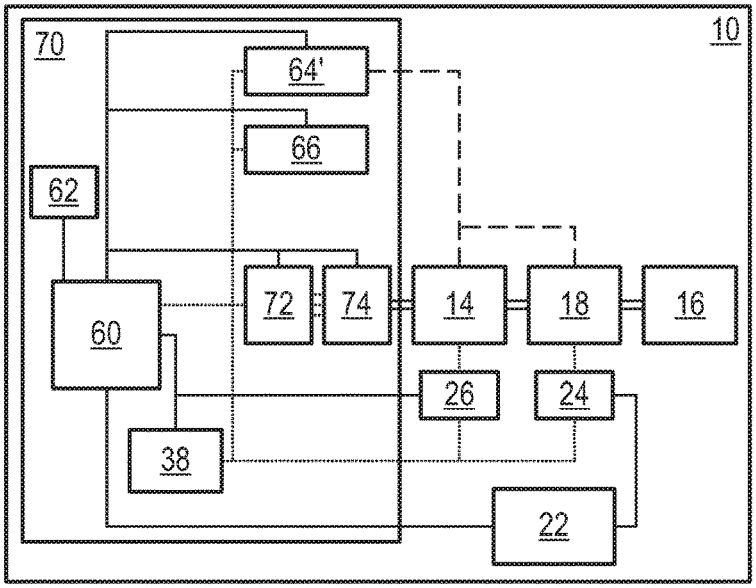
FIG. 6 shows a third embodiment of a pumping system.

FIG. 6 shows a third embodiment of a pumping system 10. Reference is also made to the previous explanations and only the differences to FIG. 5 are explained. This embodiment uses a combination of a two-way converter 72 and a three-phase electric motor 74 to start the motor 14 and, when the motor 14 is running, the electric motor 74 can be used as a generator to charge the accumulator 38.

Figure 7:
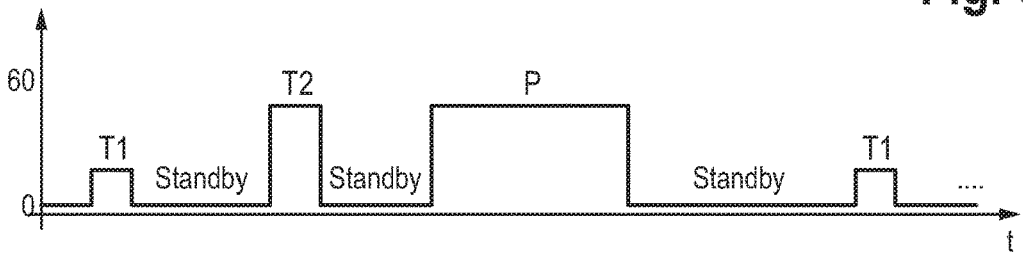
FIG. 7 shows the time sequence of a production process with two test modes.

FIG. 7 shows an embodiment of a production process in which the following operating modes are used over time: standby mode, first test mode, standby mode, second test mode, standby mode, production mode, standby mode, first test mode, standby mode etc.

In order to completely switch off motor 14 of pumping system 10 for standby mode, i.e. motor 14 stands still, and still ensure that motor 14 is immediately available again when required, an actual and an expected operating mode are determined according to the disclosure, and the operation of pumping system 10 is influenced during at least one target operating mode. In order to determine the current and expected operating mode as reliably as possible, the findings in connection with the disclosure are presented below, which may allow a reliable determination.

For the following explanations it is assumed for an embodiment that the production process has four different operating modes: 1) first test mode, duration 1 min to 10 min, without pressure; 2) second test mode, duration 5 min to 45 min, under pressure; 3) production mode, duration 1 to 4 h; and 4) standby mode, 0 to 1 h after a test mode and 1 to 4 h after a production mode.

The typical course in this embodiment is shown in FIG. 7 and can either be specified or empirically determined while in operation using statistical methods. It is preferred if the result contains data on an at least probable course of the various operating modes and data on the at least probable durations of the individual operating modes. In particular with regard to the at least probable or expected durations of the individual operating modes, production runs that have already taken place can be obtained in particular from internally stored data or tables or also via a network of other pumping systems. The data mentioned can be obtained in particular from internally stored data or tables or also via a network of other pumping systems.

The first test mode can be identified in particular by the following operating values: 1) The previous operating mode was the standby mode. 2) The operating mode before the previous operating mode was the production mode or a full shutdown. 3) Starting the motor 14 is requested or has been requested. 4) The engine speed 14 is set to a low speed, preferably close to the idling speed and especially to the idling speed, for example 700 rpm or 800 rpm. 5) The motor 14 delivers only a low torque, which is far from its maximum torque. 6) The pump delivers no pressure or only a low pressure. 7) The transmission shifts from a braked state or a neutral state to a higher gear level, in particular gear levels 4 to 7 within a short time, whereby the engine speed remains at least approximately close to the idling speed.

A full shutdown is a state of the pumping system in which the pumping system is completely switched off and the engine temperature falls below the cold start temperature in particular. Starting the system from full shutdown usually takes many minutes to half an hour.

To determine the first test mode, checking one of the above operating values may be sufficient. However, it is considered advantageous for some exemplary embodiments if at least two of the above operating values are checked and in particular all of the above operating values are checked.

In practice, the skilled person can first check whether he can determine the current operating mode with sufficient reliability for his application on the basis of a selected operating value. If this is not the case, the skilled person adds another operating value and checks the reliability again. By adding further operating values or by checking other operating values, the skilled person can achieve the desired accuracy in determining the current operating mode. This applies to all operating modes described above and below.

Knowing that the current operating mode is the first test mode, it is now possible to determine, at least with sufficient reliability, that the next operating mode will be standby mode. It is also preferable to determine, knowing a typical course of the process, that the standby mode is expected to last for a certain period of time. It is also preferable to determine that the mode after the next expected operating mode is the second test mode, which in turn can be assigned a certain period of time, for example 15 min to 45 min.

If special reliability is required when determining the first test mode, it can also be checked whether the speed of the motor is actively controlled by the motor control 26 and/or that the high pressure side of the pump 16 is not connected to the manifold.

The second test mode can be identified in particular by the following operating values: 1) The previous operating mode was the standby mode. 2) The operating mode before the previous operating mode was the first test mode. 3) Starting of engine 14 is requested or has been requested. 4) The speed of engine 14 is set to an increased speed which is significantly above the idling speed, especially above 1000 rpm. 5) The transmission shifts from a braked state or a neutral state to the first or second gear step and remains there for at least 1 min, in particular at least 2 min, with the engine speed remaining increased.

To determine the second test mode, checking one of the above operating values may be sufficient. However, it is considered advantageous for some exemplary embodiments if at least two of the above operating values are determined and in particular if all the above operating values are checked.

Knowing that the current operating mode is the second test mode, it is now possible to determine, at least with sufficient reliability, that the next operating mode will be standby mode. It is also preferable to determine, knowing a typical course of the process, that the standby mode is expected to be available for a certain period of time, e.g. about 15 min. Furthermore, it is preferable to determine that the mode after the next expected operating mode is the production mode, which in turn can be assigned a certain period of time, e.g. about two hours.

If a particularly high level of reliability is required in determining the current operating condition with respect to the second test mode, it can also be checked that the motor 14 is controlled by the engine control 26 and/or that the high pressure side of the pump 16 is connected to the manifold and generates a high pressure and/or that the user only changes gears slowly through the individual gear levels, in particular maintains one gear level for more than 30 s, preferably for more than 1 min and particularly preferably for more than 2 min.

The production mode can be identified in particular by the following operating values: 1) The previous operating mode was the standby mode. 2) The operating mode before the previous operating mode was the second test mode. 3) Starting of engine 14 is requested or has been requested. 4) The transmission shifts sequentially from a braked state or a neutral state within a few minutes through the various gear steps to a high gear step, which is then maintained for a long time, i.e. at least 2 min, preferably at least 5 min and especially preferably at least 10 min. 5) The speed of the engine 14 is set to a high speed which is significantly above the idling speed, especially above 1100 rpm. One difference to the second test mode can be that the power of the engine is higher and the time of remaining in the individual gear steps is shorter. Furthermore, the operation of several pumping systems, which can be detected particularly via the data network 62, can indicate the production mode.

Knowing that the current operating mode is the production mode, it is now possible to determine, at least with sufficient reliability, that the next operating mode will be the standby mode. It is also preferable to determine, knowing a typical course of the process, that the standby mode is expected to be available for a certain period of time, for example about 15 minutes. Further it may be advantageous for some exemplary embodiments to determine that the mode after the next expected operating mode is the first test mode, which in turn can be assigned a certain period of time, for example about two minutes.

If a particularly high level of reliability is required with regard to the production mode when determining the current operating state, it can also be checked that motor 14 is controlled by motor control 26 and/or that the high pressure side of pump 16 is connected to the manifold and generates a high pressure.

The standby mode can be recognized in particular by the fact that a control for motor 14 is effected, which brings motor 14 to a standstill. It is also possible to check that the transmission shifts to a braked or neutral state. Especially when determining the expected operating mode as standby mode, it is important to consider the expected duration of the standby mode. As explained below, the influence on the target operating mode can depend on the length of the expected operating mode to be expected as a standby mode.

Two specific embodiments of influencing are shown below, whereby the disclosure is not limited to these embodiments.

Figure 8:
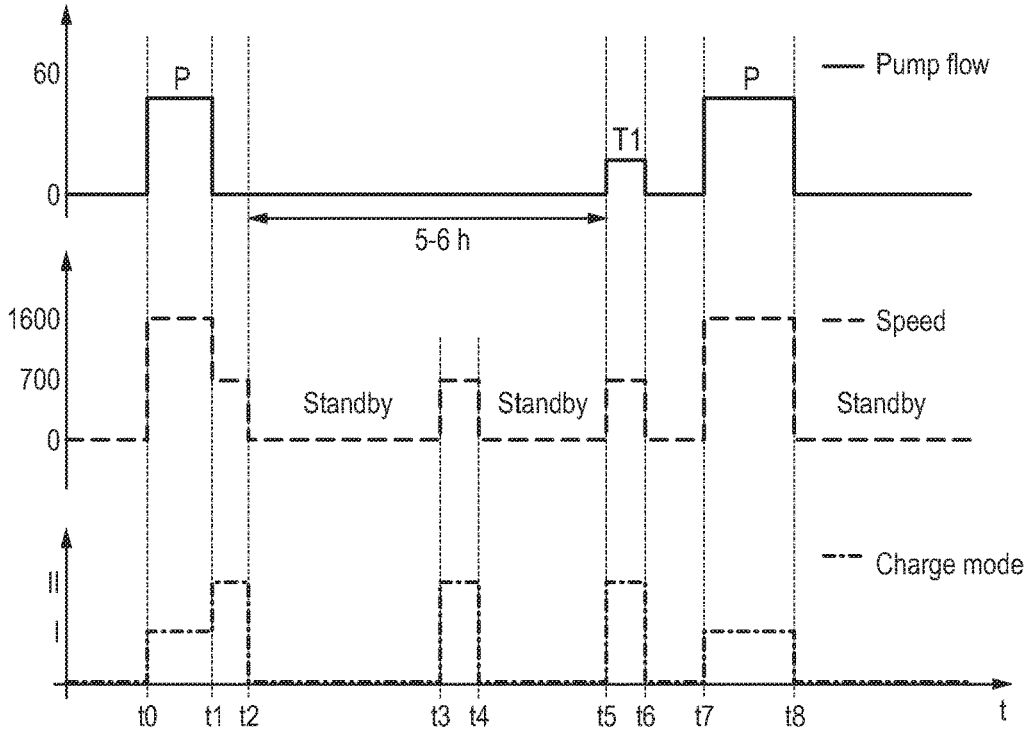
FIG. 8 shows a production process with an influence on the charging power of the accumulator.

FIG. 8 shows an embodiment in which charging of the accumulator 38 is influenced. From time t0, the pumping system 10 is in production mode until time t1. During the production mode a charging mode I is selected, which supplies a low charging power to the accumulator. However, it can be seen that the duration of the production mode from t0 to t1 is shorter than that of the—assumed to be normal—production mode from t7 to t8.

In this embodiment, the ideal setpoint of the pumping system is a charge state that the accumulator should have when the pumping system 10 goes into standby mode after a production mode. Due to the shortened production mode, the accumulator has not yet reached the ideal setpoint in charge mode I.

Therefore, at time t1, standby mode is not immediately activated, which would mean a speed of 0, but the motor continues to run at a reduced speed. In addition, it switches to charging mode II, i.e. the accumulator is provided with a high charging power. In the embodiment shown, the desired charge state of the accumulator has been reached at time t2, and only now does the pumping system 10 switch to standby mode.

Another embodiment is shown at time t3. Here, a minimum accumulator charge is considered as the ideal setpoint. In this embodiment, at time t3 it is determined that the target operating mode, in this case the current operating mode, is to be influenced so that the charge state of the accumulator is increased again. The influencing takes place such that the engine is started, charging mode II is selected and finally a return to standby mode at time t4 takes place.

A further embodiment is given with regard to time t5. By default, the accumulator would be charged in charging mode I at this time, i.e. the start of the first test mode. However, in this embodiment it is now known that the current operating mode is the first test mode, which in turn has a relatively short remaining duration. Further it is known that the first test mode is followed by the standby mode.

It is therefore possible with conventional systems that the accumulator may not be sufficiently charged due to the brevity of the first test mode. The influence now takes place in such a way that charging mode II is switched on at time t5 in order to charge the accumulator as much as possible during the first test mode.

The background to these considerations is, among other things, that the accumulator is a very expensive component and that the state of charge of the accumulator must always have a minimum state of charge during standby mode, so that the pump system is immediately available as required. On the one hand, the accumulator must be charged fast enough with regard to the running time of the motor, on the other hand, fast charging of the accumulator is detrimental to the service life of the accumulator. According to the disclosure, it is possible that the accumulator is slowly charged during long phases during which the motor is running, but at the same time short phases are used for fast charging to ensure a sufficient state of charge of the accumulator.

The cost aspect in particular is taken into account. The motors used are maintained after hours, i.e. not after kilometers as in the case of a car, for example. Every hour that the motor runs only for charging the accumulator (or during the rest period) costs more than the accumulator loses service life. This method allows to keep the costs of the accumulator as low as possible and at the same time to achieve maximum cost savings in the operating costs of the motor.

Two special implementations of a control procedure are described below. First, if the pump system is in a test mode, the power requirement for the subsequent standby mode is calculated or estimated. If the state of charge of the accumulator cannot provide this power, charging mode II is activated during the test mode. In particular, the charging current can be determined with regard to the remaining duration of the test mode and the power still to be supplied to the accumulator. If the accumulator charge level is sufficient, charging can be switched off or switched to charge retention mode.

Second, if a transition to standby mode is to be delayed at the end of a production mode, the following may be effected. During the production mode, the required state of charge of the accumulator is determined. If the state of charge is too low and the production mode still continues, the accumulator is charged in charge mode I with regard to the remaining duration of the production mode and the charge level to be achieved. If the charge level is too low and the production mode is terminated, the pump switches to charge mode II and the transition to standby mode is delayed until the required charge level is reached.

With preferred embodiments, in addition to activating charging mode II, heating mode II with high heating power is also activated. This has the advantage for some exemplary embodiments that the motor is heated up more than would be necessary for operation and thus stores additional heat. In a subsequent standby mode, it then takes longer to heat the engine again. It may even be possible to avoid heating during standby mode.

Figure 9:
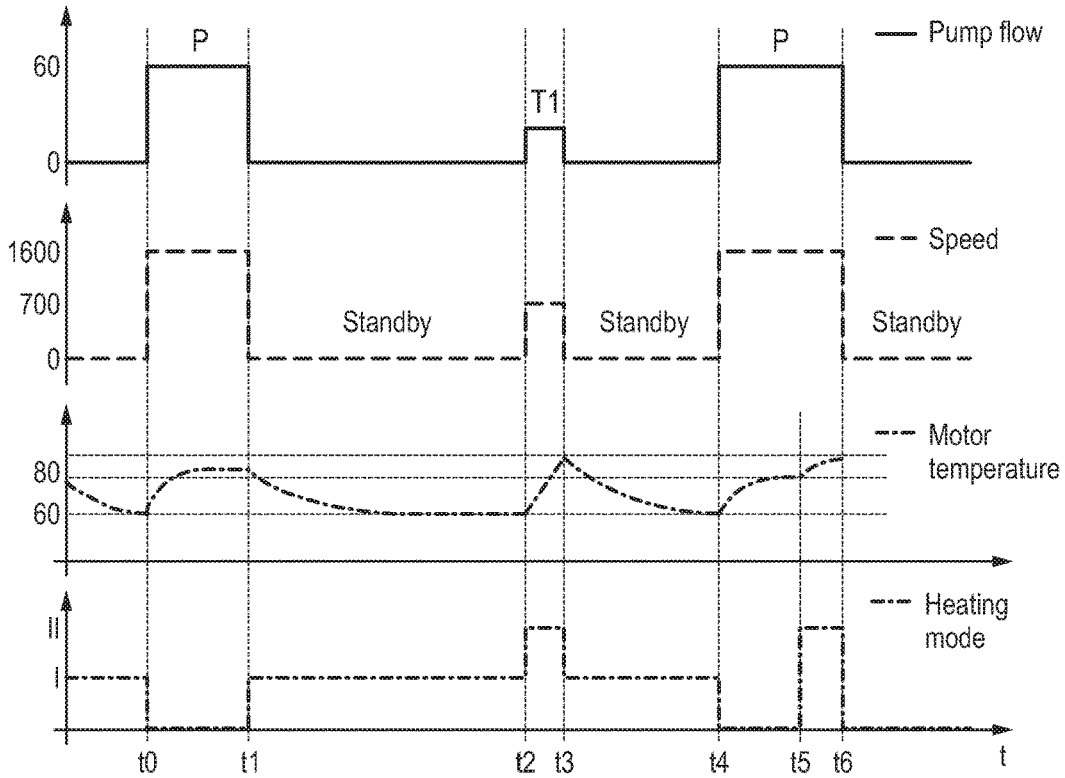
FIG. 9 shows a production process with an influence on a heating level of the heating device.

FIG. 9 shows another embodiment in which heating of the motor is in the foreground. The embodiment can be combined with the embodiments described above.

At time t0 the production mode starts. Since the motor is under high load here, heating of the motor is not necessary and the heating device is switched off. When entering standby mode at time t1, the heater is switched on so that the engine temperature does not fall below the cold start temperature of 60° C. until time t2. With the start of the first test mode at time t2, the heating would normally be switched off again. This means that the standard heating stage would be "off" here. Instead, however, the heating stage of the heating device is influenced in such a way that heating mode II is activated. In this way, the motor temperature rises to a higher value even in the short interval from t2 to t3, so that the motor temperature can be kept sufficiently high in heating mode I, i.e. at low heating power, in the subsequent standby mode.

Another possibility is shown at time t5. Here it is known that the pump system is in production mode, the remaining duration of the production mode is at least approximately known, and the following expected operating mode is standby mode. Even if it is not necessary for current operation, the heating device is switched to heating mode II in order to increase the temperature of the motor more strongly. As a result, the engine stores more energy and can be kept above the cold-start temperature in the subsequent standby mode with less heating power. A target temperature may, for example, be at least 5° C., preferably at least 10° C. and in particular at least 15° C. above the engine temperature that is reached by normal operation during standby mode.

Figure 10:
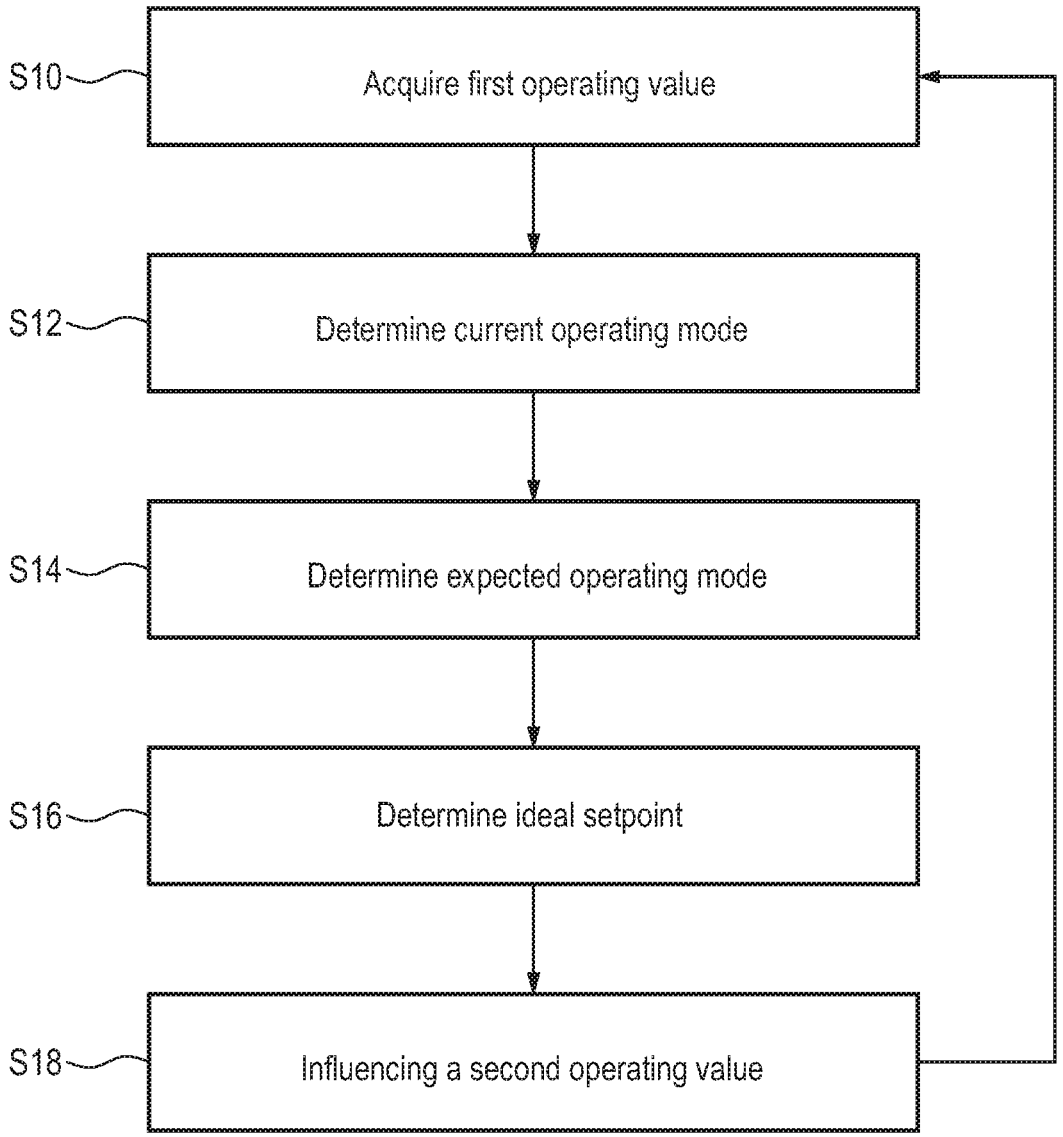
FIG. 10 shows an embodiment of a method for controlling a pumping system.

FIG. 10 shows an example of a process for controlling a pump system. At least one first operating value of the pump system is recorded in step S10. In step S12, a current operating mode of the pump system is determined taking into account the at least one first operating value. In step S14, an expected operating mode, which follows the current operating mode in time, is determined taking into account the current operating mode.

In step S16, at least one ideal setpoint of the pumping system is determined for at least one target operating mode, taking into account the expected operating mode. Finally, in step S18, at least a second operating value of the pumping system is influenced during the at least one target operating mode, taking into account the at least one ideal setpoint. It is preferred to continue the procedure with step S10.

It should be noted that the first operating value and the second operating value are usually of different types. For example, a speed of the motor is used to determine the current operating mode and a charging mode of the accumulator is affected. However, it is also conceivable that the first and second operating values could be of the same type.

What is claimed is:

1. A method for controlling a hydraulic pumping system that is stationary while in operation, the pumping system with a fuel-driven drive with a motor for a pump, a heating device for heating the motor and an accumulator with a voltage regulator, the method comprising the steps of:

acquiring at least one first operating value of the pumping system, determining a current operating mode of the pumping system taking into account the at least one first operating value, determining an expected operating mode which follows the current operating mode in time, taking into account the current operating mode, determining at least one ideal setpoint of the pumping system taking into account the expected operating mode for at least one target operating mode, and influencing at least one second operating value of the pumping system during the at least one target operating mode, taking into account the at least one ideal setpoint, wherein the at least one second operating value comprises a heating level of the heating device.

2. The method according to claim 1, further with the step of determining an expected remaining duration of the current operating mode, whereby the influencing the at least one second operating value also takes into account the expected remaining duration.

3. The method according to claim 1, wherein the at least one first operating value comprises at least two first operating values recorded at two different times.

4. The method according to claim 1, wherein the at least one first operating value comprises at least two first operating values, one of the at least two first operating values being detected during the current operating mode and another of the at least two first operating values being detected before the current operating mode.

5. The method according to claim 1, wherein the influencing of the at least one second operating value comprises an increase of the heating level during the at least one target operating mode compared to a standard heating level in the at least one target operating mode.

6. The method according to claim 1, wherein at least one determining selected from determining the current operating mode and determining the expected operating mode is performed taking into account a typical sequence of operating modes of the pumping system.

7. The method according to claim 1, wherein while in operation of the pumping system data on a sequence of operating modes of the pumping system is stored and a typical sequence of operating modes of the pumping system is determined.

8. The method according to claim 1, wherein the step of influencing comprises an influencing such that a temperature of the engine at the end of a standby mode is above a cold-start temperature.

9. The method according to claim 1, wherein the step of influencing has an influence such that the start of a standby mode is delayed and a charging current into the accumulator is increased.

10. The method according to claim 1, wherein the current operating mode and the expected operating mode are each selected from a group comprising a production mode, at least one test mode and a standby mode.

11. The method according to claim 1, wherein the at least one first operating value, the at least one second operating value and the ideal setpoint are each selected from a group comprising an engine temperature, an engine speed, a gear level of the drive, a time period from leaving a first gear level to reaching a second gear level, a time period of holding a gear level, a current operating mode, a previous operating mode, a heating level of the heating device, a charge state of the accumulator, a charging power of the accumulator and a starting operation of the engine.

12. A control device for a hydraulic pumping system that is stationary while in operation, the pumping system comprising a fuel-driven drive having a motor for a pump, a heating device for heating the motor and an accumulator having the voltage regulator, the control device having a processing unit adapted to perform a method according to claim 1.

13. A hydraulic pumping system that is stationary while in operation, the pumping system comprising a pump, a fuel-driven drive having a motor for the pump, heating means for heating the motor, an accumulator having the voltage regulator and a control device according to claim 12.

14. The hydraulic pumping system that is stationary while in operation according to claim 13, wherein the pumping system is connected to a borehole via a pipe system located outside the pumping system.

15. A method for controlling a hydraulic pumping system that is stationary while in operation, the pumping system with a fuel-driven drive with a motor for a pump, a heating device for heating the motor and an accumulator with a voltage regulator, the method comprising the steps of:

acquiring at least one first operating value of the pumping system, determining a current operating mode of the pumping system taking into account the at least one first operating value, determining an expected operating mode which follows the current operating mode in time, taking into account the current operating mode, determining at least one ideal setpoint of the pumping system taking into account the expected operating mode for at least one target operating mode, and influencing at least one second operating value of the pumping system during the at least one target operating mode, taking into account the at least one ideal setpoint, wherein the step of influencing comprises an influencing such that a temperature of the engine at the end of a standby mode is above a cold-start temperature.

16. The method according to claim 15, further with the step of determining an expected remaining duration of the current operating mode, whereby the influencing the at least one second operating value also takes into account the expected remaining duration.

17. The method according to claim 15, wherein the at least one first operating value comprises at least two first operating values recorded at two different times.

18. The method according to claim 15, wherein the at least one first operating value comprises at least two first operating values, one of the at least two first operating values being detected during the current operating mode and another of the at least two first operating values being detected before the current operating mode.

19. The method according to claim 15, wherein the at least one second operating value comprises a charging power of the accumulator.

20. The method according to claim 19, wherein the at least one second operating value comprises an increase in charging power during the at least one target operating mode compared to a standard charging power in the target operating mode.

21. The method according to claim 15, wherein at least one determining selected from determining the current operating mode and determining the expected operating mode is performed taking into account a typical sequence of operating modes of the pumping system.

22. The method according to claim 15, wherein while in operation of the pumping system data on a sequence of operating modes of the pumping system is stored and a typical sequence of operating modes of the pumping system is determined.

23. The method according to claim 15, wherein the step of influencing has an influence such that the start of a standby mode is delayed and a charging current into the accumulator is increased.

24. The method according to claim 15, wherein the current operating mode and the expected operating mode are each selected from a group comprising a production mode, at least one test mode and a standby mode.

25. The method according to claim 15, wherein the at least one first operating value, the at least one second operating value and the ideal setpoint are each selected from a group comprising an engine temperature, an engine speed, a gear level of the drive, a time period from leaving a first gear level to reaching a second gear level, a time period of holding a gear level, a current operating mode, a previous operating mode, a heating level of the heating device, a charge state of the accumulator, a charging power of the accumulator and a starting operation of the engine.

26. A control device for a hydraulic pumping system that is stationary while in operation, the pumping system comprising a fuel-driven drive having a motor for a pump, a heating device for heating the motor and an accumulator having the voltage regulator, the control device having a processing unit adapted to perform a method according to claim 15.

27. A hydraulic pumping system that is stationary while in operation, the pumping system comprising a pump, a fuel-driven drive having a motor for the pump, heating means for heating the motor, an accumulator having the voltage regulator and a control device according to claim 26.

28. The hydraulic pumping system that is stationary while in operation according to claim 27, wherein the pumping system is connected to a borehole via a pipe system located outside the pumping system.

29. A method for controlling a hydraulic pumping system that is stationary while in operation, the pumping system with a fuel-driven drive with a motor for a pump, a heating device for heating the motor and an accumulator with a voltage regulator, the method comprising the steps of:

acquiring at least one first operating value of the pumping system, determining a current operating mode of the pumping system taking into account the at least one first operating value, determining an expected operating mode which follows the current operating mode in time, taking into account the current operating mode, determining at least one ideal setpoint of the pumping system taking into account the expected operating mode for at least one target operating mode, and influencing at least one second operating value of the pumping system during the at least one target operating mode, taking into account the at least one ideal setpoint, wherein the step of influencing has an influence such that the start of a standby mode is delayed and a charging current into the accumulator is increased.

30. The method according to claim 29, further with the step of determining an expected remaining duration of the current operating mode, whereby the influencing the at least one second operating value also takes into account the expected remaining duration.

31. The method according to claim 29, wherein the at least one first operating value comprises at least two first operating values recorded at two different times.

32. The method according to claim 29, wherein the at least one first operating value comprises at least two first operating values, one of the at least two first operating values being detected during the current operating mode and another of the at least two first operating values being detected before the current operating mode.

33. The method according to claim 29, wherein the at least one second operating value comprises a charging power of the accumulator.

34. The method according to claim 33, wherein the at least one second operating value comprises an increase in charging power during the at least one target operating mode compared to a standard charging power in the target operating mode.

35. The method according to claim 29, wherein at least one determining selected from determining the current operating mode and determining the expected operating mode is performed taking into account a typical sequence of operating modes of the pumping system.

36. The method according to claim 29, wherein while in operation of the pumping system data on a sequence of operating modes of the pumping system is stored and a typical sequence of operating modes of the pumping system is determined.

37. The method according to claim 29, wherein the step of influencing comprises an influencing such that a temperature of the engine at the end of a standby mode is above a cold-start temperature.

38. The method according to claim 29, wherein the current operating mode and the expected operating mode are each selected from a group comprising a production mode, at least one test mode and a standby mode.

39. The method according to claim 29, wherein the at least one first operating value, the at least one second operating value and the ideal setpoint are each selected from a group comprising an engine temperature, an engine speed, a gear level of the drive, a time period from leaving a first gear level to reaching a second gear level, a time period of holding a gear level, a current operating mode, a previous operating mode, a heating level of the heating device, a charge state of the accumulator, a charging power of the accumulator and a starting operation of the engine.

40. A control device for a hydraulic pumping system that is stationary while in operation, the pumping system comprising a fuel-driven drive having a motor for a pump, a heating device for heating the motor and an accumulator having the voltage regulator, the control device having a processing unit adapted to perform a method according to claim 29.

41. A hydraulic pumping system that is stationary while in operation, the pumping system comprising a pump, a fuel-driven drive having a motor for the pump, heating means for heating the motor, an accumulator having the voltage regulator and a control device according to claim 40.

42. The hydraulic pumping system that is stationary while in operation according to claim 41, wherein the pumping system is connected to a borehole via a pipe system located outside the pumping system.

* * * * *